US010920533B2

(12) United States Patent
Woie

(10) Patent No.: US 10,920,533 B2
(45) Date of Patent: Feb. 16, 2021

(54) METHOD AND APPARATUS FOR WASHING AN UPPER COMPLETION

(71) Applicant: ConocoPhillips Company, Houston, TX (US)

(72) Inventor: Rune Woie, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 130 days.

(21) Appl. No.: 16/196,207

(22) Filed: Nov. 20, 2018

(65) Prior Publication Data

US 2019/0162049 A1 May 30, 2019

Related U.S. Application Data

(60) Provisional application No. 62/591,025, filed on Nov. 27, 2017.

(51) Int. Cl.

| | |
|---|---|
| ***E21B 37/00*** | (2006.01) |
| ***E21B 47/117*** | (2012.01) |
| ***E21B 37/02*** | (2006.01) |
| ***E21B 47/005*** | (2012.01) |
| ***E21B 33/14*** | (2006.01) |
| *E21B 34/06* | (2006.01) |

(52) U.S. Cl.

CPC ..... *E21B 37/02* (2013.01); *E21B 33/14* (2013.01); *E21B 47/005* (2020.05); *E21B 47/117* (2020.05); *E21B 34/06* (2013.01); *E21B 2200/04* (2020.05)

(58) Field of Classification Search

CPC ..... E21B 37/00; E21B 43/08; E21B 43/10; E21B 47/117

See application file for complete search history.

(56) References Cited

U.S. PATENT DOCUMENTS

| | | | | |
|---|---|---|---|---|
| 4,595,058 | A * | 6/1986 | Nations | E21B 17/1078 166/242.1 |
| 5,282,509 | A | 2/1994 | Schurr, III | |
| 6,408,945 | B1 | 6/2002 | Telfer | |
| 2003/0201102 | A1* | 10/2003 | Mackenzie | E21B 47/117 166/250.08 |
| 2004/0177967 | A1 | 9/2004 | Hirth | |
| 2007/0246217 | A1 | 10/2007 | Tulloch et al. | |
| 2012/0055681 | A1 | 3/2012 | Telfer | |
| 2012/0175108 | A1* | 7/2012 | Foubister | E21B 23/02 166/250.01 |
| 2016/0102523 | A1 | 4/2016 | Sponchia et al. | |
| 2016/0326807 | A1 | 11/2016 | Jerez et al. | |
| 2018/0252069 | A1* | 9/2018 | Abdollah | E21B 33/134 |
| 2018/0258738 | A1* | 9/2018 | Ian | E21B 34/06 |

FOREIGN PATENT DOCUMENTS

WO 20140168485 A1 10/2014

OTHER PUBLICATIONS

International Search Report PCT/US2018/061957, dated Feb. 4, 2019, 3 pgs.

* cited by examiner

*Primary Examiner* — Robert E Fuller
(74) *Attorney, Agent, or Firm* — Conocophillips Company

(57) ABSTRACT

The cleaning of a wellbore which has a casing in its upper part and a reservoir liner at its lower end by running only one string into the wellbore to cement the liner in place and to clean both the liner and the upper part of the well. Thus, the entire well is made ready for completion in a single trip.

6 Claims, 2 Drawing Sheets

METHOD AND APPARATUS FOR WASHING AN UPPER COMPLETION

CROSS-REFERENCE TO RELATED APPLICATIONS

This application is a non-provisional application which claims benefit under 35 USC § 119(e) to U.S. Provisional Application Ser. No. 62/591,025 filed Nov. 27, 2017, entitled "METHOD AND APPARATUS FOR WASHING AN UPPER COMPLETION," which is incorporated herein in its entirety.

STATEMENT REGARDING FEDERALLY SPONSORED RESEARCH OR DEVELOPMENT

None.

FIELD OF THE INVENTION

This invention relates to the washing of a cased length of a hydrocarbon production well or water injector well, above the reservoir liner and in particular to a method and apparatus for achieving such washing efficiently and making savings on the amount of time needed for the washing operation.

BACKGROUND OF THE INVENTION

When a hydrocarbon well, or water injector well is drilled, casing is installed in the upper region of the well and then, normally, a reservoir liner is run into the well on drill pipe equipped with a reservoir liner hanger. Once the reservoir liner hanger is in place, cement is displaced into the reservoir liner and back up the annulus outside the reservoir liner, cementing it in position, and the liner is left filled with drilling mud. At this stage mud is circulated in the casing to remove residual cement, metal swarf, etc. The drill string is removed and a special cleanout string run in to the end of the reservoir liner. The casing and reservoir liner are then washed out with various fluids, and the portion of the casing in which the production packer is to be set is further cleaned with a scraper device. The well is thereby put into a suitable state to be filled with completion fluid and completed. The well cleanout string is relatively delicate since it must be narrow enough to extend through the reservoir liner. Because it is delicate it needs to be run in slowly.

Casing wash tooling is specially designed for the operation. It is designed to be rotated in the well; this is necessary in order to achieve effective washing. Since the well may be highly deviated, the string tends to lie on the lower side of the casing and, in the absence of rotation, only the region above the string will be effectively washed.

The casing wash tooling is also specially designed to carry out a so-called inflow test to check that there is no leakage of fluid from the reservoir liner or into the reservoir or production casing/liner. The casing wash process takes many days with associated cost and it is desirable to reduce this. The process is also risky since the thin cleanout string which passes down the reservoir liner is delicate and easily damaged.

BRIEF SUMMARY OF THE DISCLOSURE

According to the invention a process for washing a wellbore comprises passing a drill string, including a reservoir liner hanger running tool, down a cased wellbore to install a reservoir liner in an uncased distal portion of the wellbore; displacing cement into the reservoir liner annulus by passing completion fluid through the drill string and reservoir liner; without first removing the drill string from the wellbore, performing an inflow test on the reservoir liner; and washing the interior of the casing by passing wash fluid through the drill string and into the casing, whilst rotating the drill string.

Also according to the invention, an apparatus for washing a cased wellbore comprises a drill pipe having an assembly fitted to a distal end thereof, the assembly comprising: a reservoir liner hanger and reservoir liner hanger running tool; and an inflow test tool capable of forming a sealed connection between the drill string and the reservoir liner or reservoir liner hanger, for performing an inflow test on the reservoir liner.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
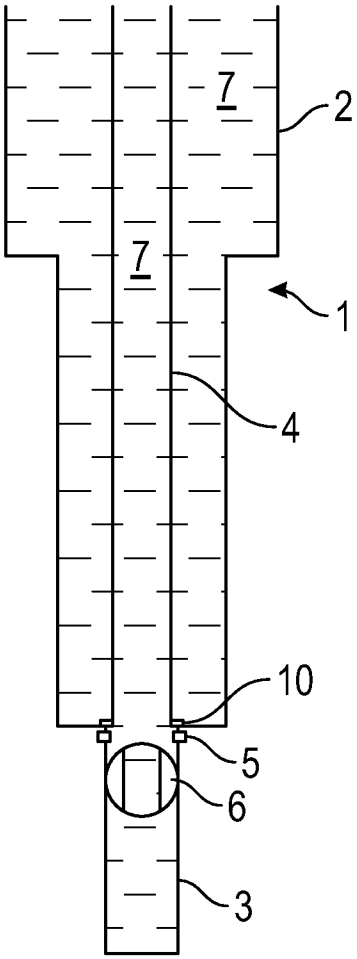
FIG. 1 is a schematic sectional view of a wellbore comprising a cased upper region above a reservoir liner, prior to a reservoir liner cementing operation.

Referring firstly to FIG. 1, a wellbore 1 comprises an upper, cased part 2 underneath which is a reservoir liner 3. Extending through the wellbore approximately to the junction between the upper part 2 and reservoir liner 3 is a drill string 4. At the distal end of the drill string is an assembly comprising a reservoir liner hanger 5, associated reservoir liner hanger running tool 10, which in FIG. 1 is connected to the reservoir liner hanger, and a ball valve 6. The assembly also comprises a scraper tool for cleaning a section of the interior of the casing above the reservoir liner hanger 5. At the distal end of the reservoir liner is a burst disc. The scraper tool and burst disc are omitted from the drawings for clarity. They are standard components whose design and functionality will be familiar to anyone of ordinary skill in this field. The function of all these components will be described below. At the distal end of the drill string 4 is an inflow test seal, also omitted from the drawings for clarity and whose function will be explained below.

At the stage illustrated in FIG. 1, the reservoir liner 3 has been placed by the drill string 4 at a desired depth. The reservoir liner hanger 5 has not yet been set. The wellbore is filled with drilling mud 7 to balance/control the well pressures. In an alternative method, the reservoir liner hanger is set before the cement is displaced.

Figure 2:
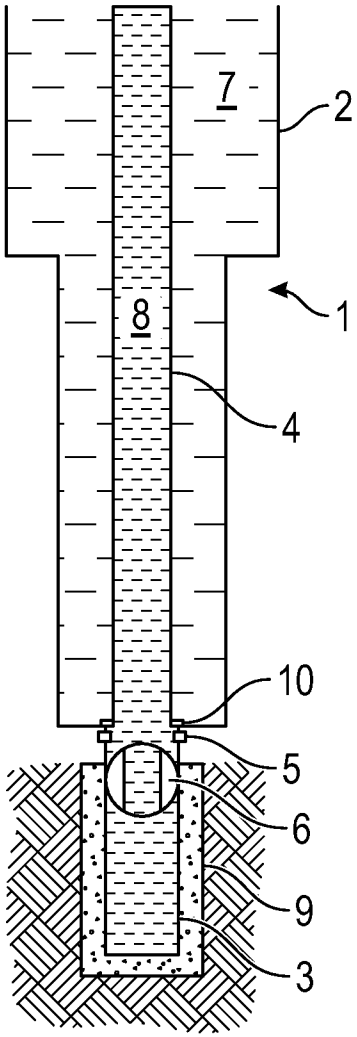
FIG. 2 is a schematic sectional view of the wellbore after cementing of the liner.

Referring to FIG. 2, a cementing job is now performed by introducing cement into the drill string 4. A volume of cement sufficient to fill the annulus around the reservoir liner 3 is introduced into the drill string 4, immediately followed by a cleaning plug and completion fluid 8 (in this case, brine). As the completion fluid displaces the cement through the reservoir liner 3, the cleaning plug substantially prevents cement being left on the reservoir liner interior wall.

An appropriate volume of completion fluid 8 is pumped down the drill string 4 to displace all the cement into the annulus of 3. Cement filling the annulus is shown at 9 in FIG. 2. At this point the drill string 4 and the entire length of the internal bore of the reservoir liner 3 are filled with brine 8. The reservoir liner hanger will now be set, anchoring the reservoir liner 3 to the upper, cased part 2 and creating a continuous seal between these.

Figure 3:
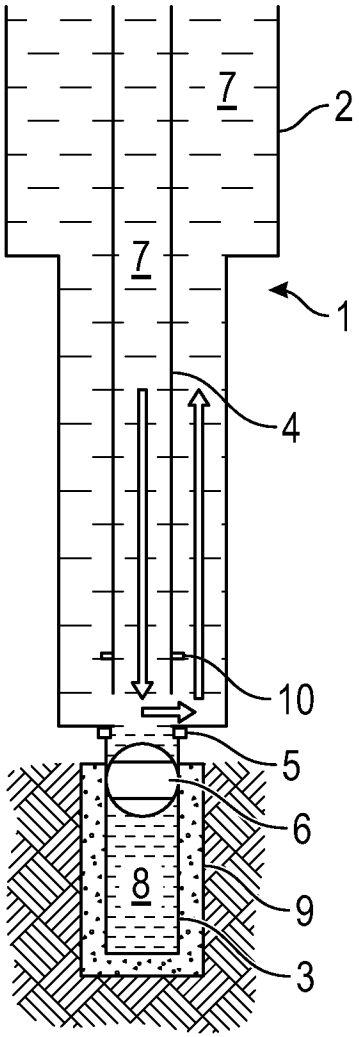
FIG. 3 is a schematic sectional view of the wellbore with drilling mud being circulated in the upper region of the well.

The drill string 4 is then withdrawn slightly so that its distal end, with the reservoir liner hanger running tool 10, is detached from and right above the reservoir liner hanger 5. This action closes the ball valve 6 by pulling a shifting tool past a shifting profile (a technique for actuating down-hole components which is well known in this field). This state is shown in FIG. 3. The ball valve 6 keeps the completion fluid 8 in the reservoir liner 3 separated from the upper, cased well volume 2 above, i.e. prevents debris from the upper part of the well from falling into the reservoir liner. The closing of the valve 6 is not limited to pulling a shifting tool past a shifting profile, but could also be achieved by a clock timer, pressure pulses, or any other technique known generally in this field. The ball valve 6 could be replaced by any suitable type of mechanical valve, e.g. a flapper valve, but a ball valve is preferred because the ball valve can also act to prevent fluid flow in the opposite sense, e.g. as a barrier in case of a leak in the reservoir liner.

The ball valve 6 is actuated by the drill string being withdrawn, and this helps prevent the completion fluid in the reservoir liner from becoming contaminated with solid material from above.

In a modified apparatus and method, the ball valve 6 is not present, nor circulation is started. The inventor believes that the process for cleaning of the upper completion, as described below, is so short (perhaps of the order of 2 hours) that this will give rise to very little, if any, solid material falling into the reservoir liner even if no valve is present. The short time for the cleaning operation means that there may be insufficient time for the drilling mud to heat up appreciably; it is when the drilling mud becomes hot (i.e. is heated to the temperature of the formation which can be around 150 degrees Celsius or more) that solids (e.g. barite) tend to settle out of the mud, so for this reason also the valve 6 may not be necessary. With circulation started any debris from upper part of the well will not permitted entering the reservoir liner 3.

The casing scraper tool (not shown in the drawings) that was previously collapsed in the reservoir liner expands to scrape the production casing string that hosts the reservoir liner hanger 5. The drill string 4 is rotated and/or reciprocated, which causes the scraper tool to scrape clean a portion of the interior of the casing the portion which will receive a production packer at a later stage in the completion of the well.

Drilling mud is continuously circulated, with the drill string rotating, to clean heavy debris from the upper part of the well, above the reservoir liner hanger. Debris such as cement and metal swarf can be removed by the heavy drilling mud. Rotation of the drill string ensures that the entire inner surface of the casing above the reservoir liner hanger is cleaned.

Figure 4:
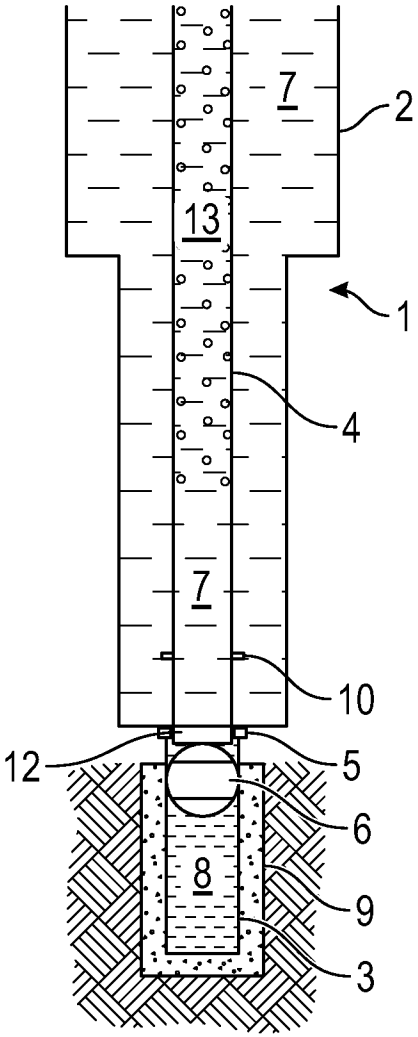
FIG. 4 is a schematic sectional view of the wellbore showing the configuration for an inflow test.

After circulation of mud, the rotation of the string is stopped and an underbalanced fluid is circulated down the drill string. This is shown in FIG. 4. The inflow seal is stung into a polished bore receptacle ("PBR") of the reservoir liner hanger. Although the inflow seal and PBR are not shown as such in the drawings, in FIG. 4 it can be seen that the end of the drill string is engaged once more with the liner hanger and a seal at the end of the drill string is schematically shown at 12.

The PBR need not be part of the liner hanger and may alternatively be provided on another part, above or below the liner hanger assembly. PBRs are well known in themselves and their structure and function will be apparent to one of ordinary skill in this field.

Together the inflow seal and PBR provide a temporary seal between the drill string and reservoir liner, isolating the interior of the drill string 4 and reservoir liner 3 from the annulus between the drill string and casing 2.

Once the seal between the drill string and PBR/reservoir liner is engaged, the underbalanced fluid causes the reservoir liner to be underbalanced to the reservoir allowing the inflow test of the reservoir liner.

The underbalanced fluid in the drill string is created by displacing some of the mud in the string with a light oil or base oil, shown at 13 in FIG. 4, having a density lower than the completion fluid. If fluid in the drill string is detected coming to surface, this is an indication of a leak in the reservoir liner. It is important to conduct such an inflow test prior to completing the well.

In an alternative method, which saves time but is less safe because the degree of underbalance cannot be controlled, the mud in the drill string is simply displaced to completion fluid and the inflow test then done.

After the inflow test, the inflow seal is disengaged from the PBR and the underbalanced fluid in the drill pipe is circulated out of the well. The upper part of the wellbore is washed with a wash train comprising a sequence of different fluids as is well known in this field. During this process the drill string is rotated. Rotation of the drill string throughout the washing provides for efficient displacement. The casing scraper tool may be employed again (or alternatively for the first time) at this point in the process. Reciprocation of the drill string causes the scraper to scrape the casing where the production packer for the upper completion will be placed and set after the drill string is retrieved.

Figure 5:
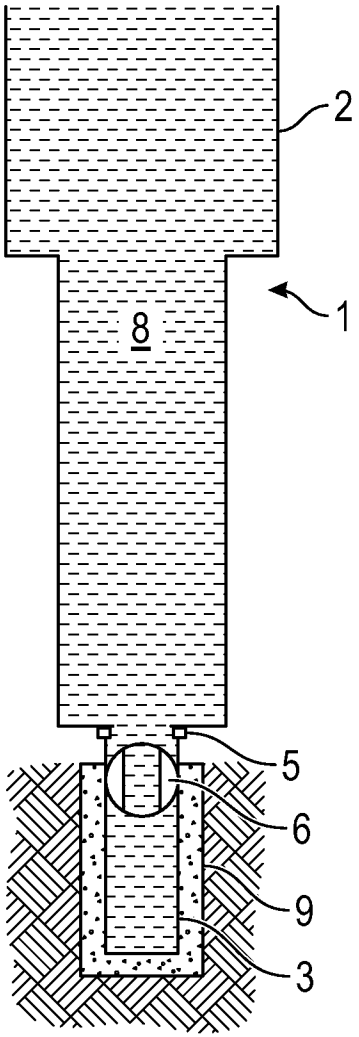
FIG. 5 a schematic sectional view of the wellbore showing the entire wellbore filled with completion fluid.

Finally the upper part of the wellbore is displaced to completion fluid 8 and the drill string withdrawn. This is shown in FIG. 5.

The process described avoids the running of a separate cleanout string either to clean the reservoir liner or to clean out the upper part of the wellbore. Several days of rig time can be saved as well as avoiding the hazardous process of running a narrow cleanout string into the reservoir liner, which is prone to failure by buckling.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for washing a wellbore, the process comprising:

a) passing a drill string, including a reservoir liner hanger running tool, down a wellbore having a casing, to install a reservoir liner in an uncased distal portion of the wellbore;

b) displacing cement into an annulus around the reservoir liner by passing completion fluid through the drill string and reservoir liner;

c) without first removing the drill string from the wellbore, performing an inflow test on the reservoir liner; and d) washing an interior of the casing by passing wash fluid through the drill string and into the casing, while rotating the drill string.

2. The process of claim 1 comprising, prior to step (c), circulating drilling mud through the drill string and cased wellbore.

3. The process of claim 1 comprising, prior to step (c), scraping a portion of the interior surface of the casing of the wellbore to prepare it to have a production packer set.

4. The process of claim 1 wherein the step of performing an inflow test comprises partly filling the drill string with a fluid having a lower density than completion fluid that has previously been placed in the reservoir liner and then forming a sealed connection between the drill string and reservoir liner, relieving pressure on the drill string fluid and testing for backflow of fluid from the reservoir liner.

5. The process of claim 4 wherein the sealed connection between the drill string and reservoir liner is made by inserting a tool at a distal end of the drill string into a polished bore receptacle of the reservoir liner hanger.

6. The process of claim 1 wherein, after step (b) a valve is closed at the top of the reservoir liner to prevent solid material falling into the reservoir liner.

* * * * *